United States Patent [19]

Gonzalez

[11] 4,351,402

[45] Sep. 28, 1982

[54] BODY STRUCTURE AND NOZZLE FOR ENHANCING THE FLOW OF DRILLING FLUID IN A ROTARY DRILL BIT

[76] Inventor: Eduardo B. González, Ave. Universidad Num. 482, Mexico 13, D.F., Mexico

[21] Appl. No.: 153,683

[22] Filed: May 27, 1980

[51] Int. Cl.[3] ..... E21B 10/60

[52] U.S. Cl. ..... 175/340; 175/408

[58] Field of Search ..... 175/228, 339, 340, 353, 175/354, 343, 408, 350

[56] References Cited

U.S. PATENT DOCUMENTS

| | | | |
|---|---|---|---|
| 959,539 | 5/1910 | Hughes | 175/228 |
| 1,238,757 | 9/1917 | Gardner | 175/354 |
| 1,334,632 | 3/1970 | Dickins | 175/228 |
| 2,025,260 | 12/1935 | Zublin | 175/340 |
| 2,526,838 | 10/1950 | Akeyson | 175/339 |
| 2,877,988 | 3/1959 | Cameron et al. | 175/329 |
| 3,429,390 | 2/1969 | Bennett | 175/343 |
| 4,154,312 | 3/1971 | Barnetche | 175/228 |
| 4,168,755 | 9/1979 | Willis | 175/215 |
| 4,203,496 | 5/1980 | Baker | 175/343 |

*Primary Examiner*—William F. Pate, III

*Attorney, Agent, or Firm*—Armstrong, Nikaido, Marmelstein & Kubovcik

[57] ABSTRACT

A rotary drill bit for drilling a bore hole in the surface of the earth is provided in which the drill bit comprises a body having a duct therethrough for carrying drilling fluid. A conical cutting head having an axis at an acute angle with respect to the axis of the drill bit is mounted in the cutting head. An elongated nozzle is positioned at the end of the duct for injecting the drilling fluid into the bore hole. The nozzle has an opening which opens into the bore hole wherein the longitudinal center line of the opening follows the locus of the mid-point between the side wall of the bore hole and the outermost circumference of the cutting head. Drilling fluid injected through the nozzle removes detritus from between the teeth and the cutting head at the bottom of the bore hole. The body of the drill bit has a first portion having a truncated conical surface with the axis of the truncated cone coinciding with the axis of the cutting head. The surface of the truncated cone is tangent to the side surface of the bore hole at a line on the opposite side of the body from the nozzle. This forms a passage between the surface of the truncated cone and the side surface of the bore hole for the upward flow of drilling fluid and detritus.

22 Claims, 4 Drawing Figures

BODY STRUCTURE AND NOZZLE FOR ENHANCING THE FLOW OF DRILLING FLUID IN A ROTARY DRILL BIT

BACKGROUND OF THE INVENTION

1. Field of the Invention

The present invention is directed to a rotary drill bit for drilling a bore hole in the surface of the earth and more particularly to a drill bit body having an elongated nozzle therein wherein the nozzle is positioned to inject drilling fluid into the bore hole to optimize the cleaning effect of the detritus between the teeth of the cutting head of the drill bit and in the bottom of the bore hole without causing damage to the drill bit seals. The body of the drill bit is formed to provide passages for the upward flow of drilling fluid with detritus therein.

2. Description of the Prior Art

It is well known in the art of drilling to inject drilling fluit into a bore hole in order to remove detritus from between the teeth of a cutting head and from the bottom of the bore hole and to carry the detritus upwards towards the surface.

U.S. Pat. No. 4,154,312, the disclosure of which is incorporated herein by reference, is directed to a rotary drill bit with a solid conical cutting head in which drilling mud or drilling fluid is injected into the bore hole through a circular nozzle located on the side of the drill bit. The flow of drilling mud through the nozzle is such that it removes detritus from between the teeth and from the bottom of the bore hole. In this prior art device, however, the nozzle size is limited by the diameter of the periphery of the drill bit and the requirement to maintain sufficient thickness of the drill bit body and nozzle so that it can withstand the extreme conditions in the bore hole environment. In order to maintain the required thickness of the drill bit body, it is necessary to position the drill bit relatively high on the drill bit body. This results in a spreading of the drilling fluid as it is injected into the bore hole which in turn results in drilling fluid being directed into the drill bit seals. The drilling fluid can have a very damaging effect to the drill bit seals. Furthermore, the drill bit disclosed in U.S. Pat. No. 4,154,312 does not include a body structure which provides passages for the upward flow of detritus and drilling fluid.

U.S. Pat. No. 2,335,929 is directed to a roller bit which includes an elongated nozzle for injecting drilling mud into a bore hole. In this patent, however, the nozzle is positioned with respect to the cutting head such that the drilling mud which flows through the nozzle does not remove the detritus from between the teeth of the cutting head. In this reference, it is necessary to provide an additional passage and nozzle in the body of the drill bit to inject drilling fluid for the purpose of removing the detritus from between the teeth of the drilling head.

SUMMARY OF THE INVENTION

It is the primary object of the present invention to provide a rotary drill bit which includes an elongated nozzle for injecting drilling fluid into a bore hole where the nozzle is formed and positioned to optimize the flow of drilling fluid.

It is another primary object of the present invention to provide a rotary drill bit which has a body having a shape such that passages are formed between the surface of the body and the sides of a bore hole for the upward flow of drilling fluid and detritus.

It is another object of the present invention to provide a rotary drill bit having an elongated nozzle wherein the locus of the center line of the nozzle opening follows the locus of the mid-point between the side wall of a bore hole and the outermost circumference of the cutting head of the drill bit.

It is still another object of the present invention to provide a rotary drill bit in which the body of the drill bit has a portion having a truncated conical surface, the axis of the truncated conical surface coinciding with the axis of the cutting head.

It is still a further object of the present invention to provide a rotary drill bit having an elongated nozzle wherein the length of the nozzle is such as to optimize the downward flow of drilling fluid through the nozzle and the upward flow of the drilling fluid and detritus around the surface of the drill bit body.

It is a still further object of the present invention to provide a rotary drill bit having an elongated nozzle wherein the nozzle is formed to inject a stream of drilling fluid into a bore hole wherein the stream has parallel sides corresponding to the longitudinal sides of the opening, thereby minimizing the spread of the stream.

The present invention is directed to a rotary drill bit for drilling a bore hole in the surface of the earth. The drill bit comprises a body having a duct therethrough for carrying drilling fluid connected through a drill string. A conical cutting head has an axis at an acute angle with respect to the axis of the drill bit with the cutting head having a conical head portion with a plurality of teeth thereon and a stem portion, the stem portion being positioned in the body for mounting the cutting head on the body. An elongated nozzle is positioned at the end of the duct. The nozzle has an opening which opens into the bore hole wherein the longitudinal center line of the opening coincides with the locus of the mid-point between the side wall of the bore hole and the outermost circumference of the cutting head, and wherein the drilling fluid injected through the nozzle removes detritus from between the teeth of the cutting head and from the bottom of the bore hole. The body has a first portion which has a truncated conical surface, the axis of which coincides with the axis of the cutting head. The surface of the truncated cone is tangent to the side of the surface of the bore hole at a line on the opposite side of the body from the nozzle. A passage for the upward flow of drilling fluid and detritus is formed between the surface of the truncated cone and the side surfaces of the bore hole. The body of the drill bit also includes a second portion which is positioned above the first portion which has a cylindrical surface with a diameter corresponding to the diameter of the bore hole. Portions of the cylindrical surface are removed to form planar surfaces.

The drill bit of the present invention also includes stabilizers mounted on the first portion of the body for stabilizing the rotation of the drill bit. The opening of the nozzle in the drill bit may be either a single elongated nozzle or a plurality of openings aligned on the longitudinal center line of the elongated nozzle.

DETAILED DESCRIPTION OF THE PREFERRED EMBODIMENT

Figure 1:
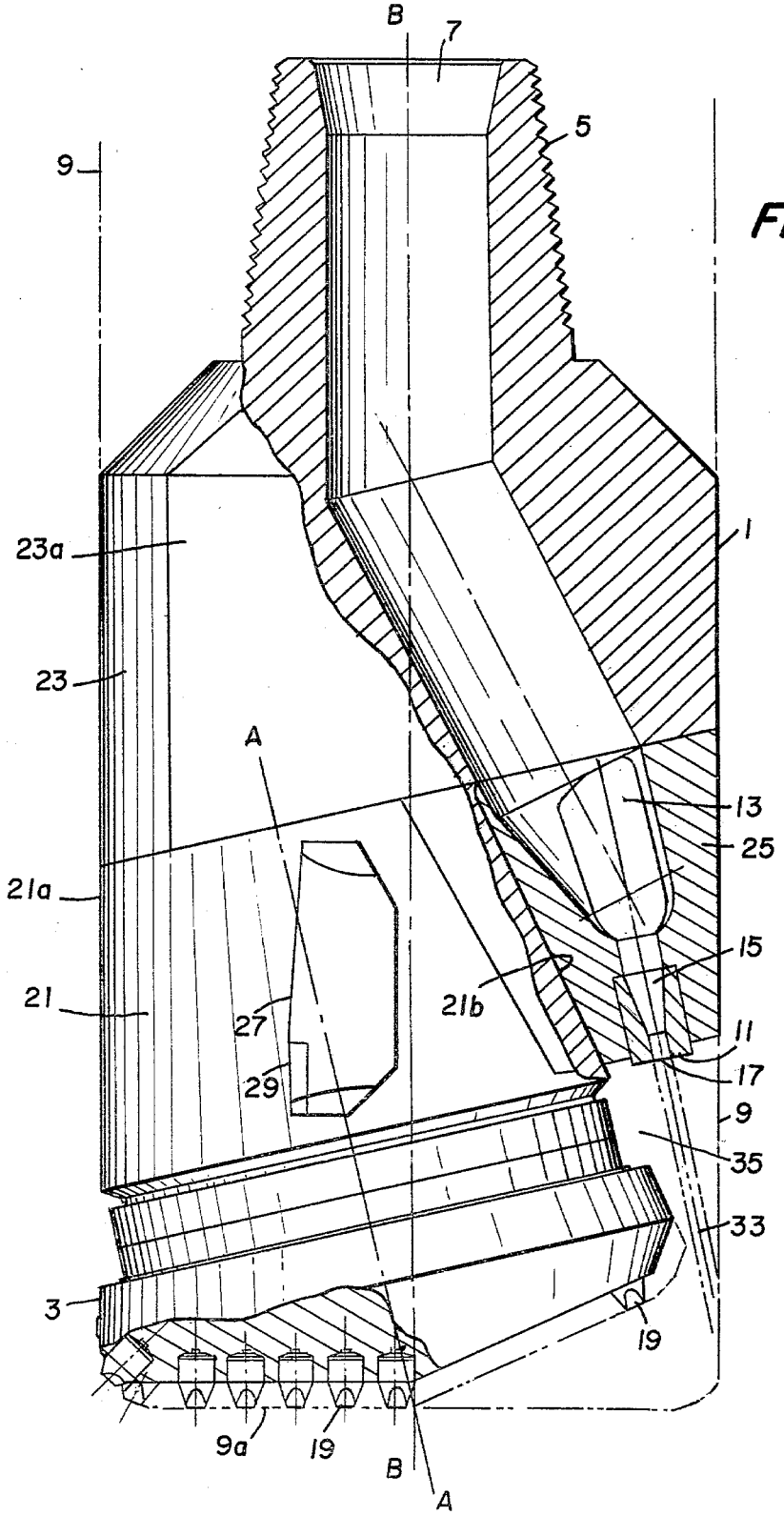
FIG. 1 is an elevational view in partial section of the preferred embodiment of the present invention.
Figure 2:
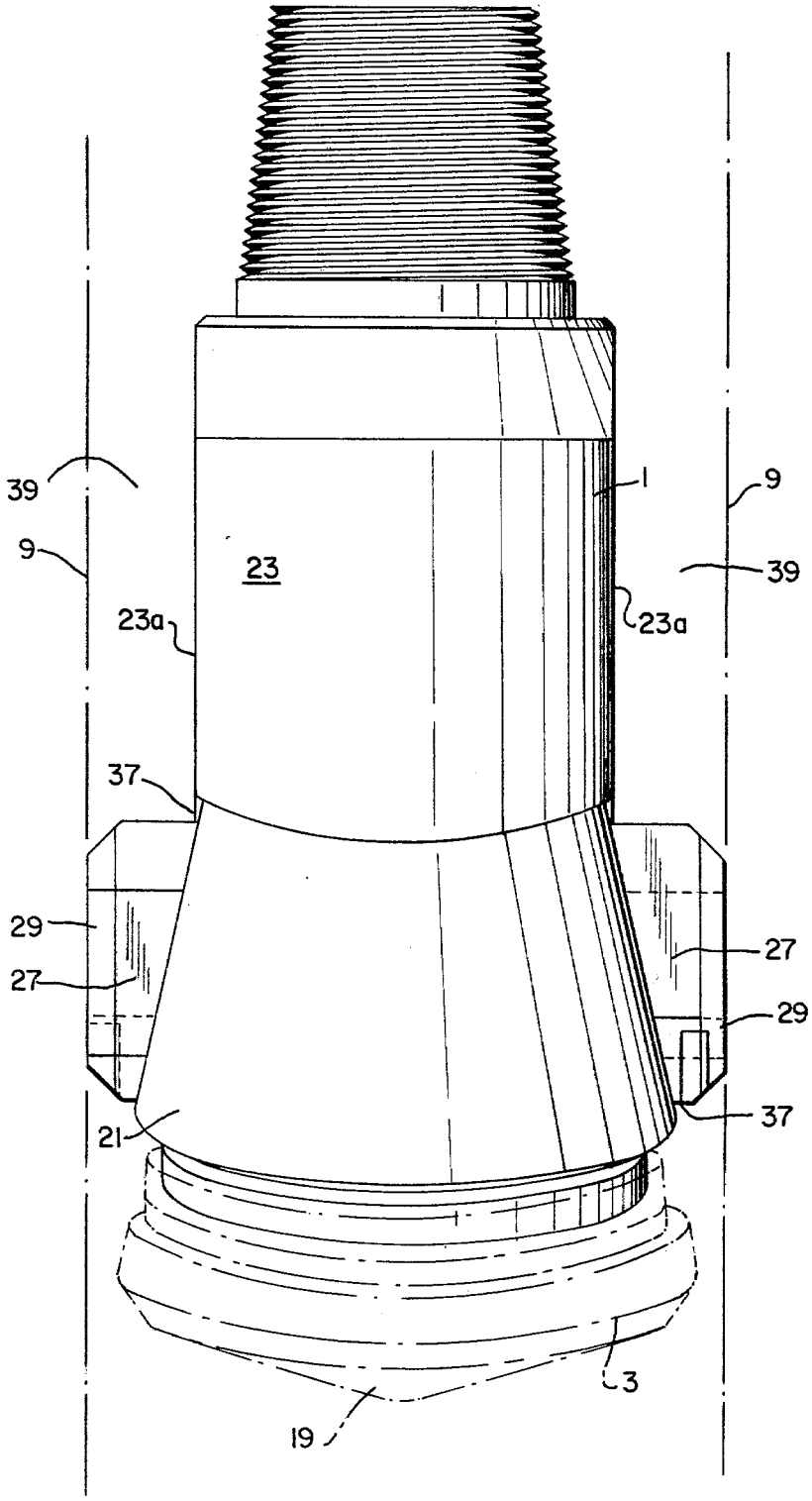
FIG. 2 is an elevational view of the drill bit of the present invention as seen from the left side of FIG. 1.

Referring to the drawings, the rotary drill bit of the present invention has a body 1 and a cutting head 3. The body 1 has a connecting portion 5 which is adapted to be connected to a drill string. A duct 7 within the body 1 carries drilling fluid pumped down into the well through the drill string and injects the drilling fluid into the bore hole 9 indicated by the phantom lines. The drilling fluid is injected into the bore hole through an elongated nozzle 11, which may be made of a hard material such as tungsten carbide. The duct and nozzle include portions 13 and 15 which transform the shape of the stream of drilling fluid from the shape of the duct 7 to the shape of the opening 17 of the nozzle 11 with a minimum of turbulence.

The body 1 has a first portion 21 which has the shape of a truncated cone having an axis corresponding to the axis A—A of the conical cutting head. The portion 21 is oriented such that the edge 21*a* is tangent to the bore hole 9. The other side of the conical portion is shown at 21*b*. The portion 21 may be formed, for example, by taking a cylindrical piece of stock and turning it about the axis A—A.

Body 1 has a second portion 23 which is positioned above and adjacent to portion 21, the portion 23 having a cylindrical surface. Side portions of the cylinder 23 are removed, for example, by milling in order to form planar surfaces 23*a* on opposite sides of the cylindrical portion 23. The portions 21 and 23 are integrally formed from the same piece of cylindrical stock.

The drill bit body 1 also includes a third portion 25, which is mounted on the body in contact with portions 21 and 23. The portion 25 has the nozzle 11 mounted therein. The portion 25 may be fixed to the portions 21 and 23 by means of welding, for example.

Stabilizers 27 are mounted on body portion 21. The stabilizers extend outward to contact the sides of the bore hole in order to stabilize the rotation of the drill bit. Furthermore, the stabilizers will also act as cutting blades against the side of the bore hole in order to form smooth sides. The leading edges of the stabilizers 27 may be formed from inserts 29 of a very hard material such as silicon carbide or tungsten carbide in order to reduce wear and to enhance the cutting action.

The cutting head 3 has a conical cutting portion with a plurality of teeth 19 inserted therein. The axis of the conical cutting head A—A is at an acute angle with respect to the axis of the drill bit B—B. In operation when the drill bit is rotated, some of the teeth are in contact with the bottom of the bore hole 9*a* and others of the teeth are positioned at a maximum distance above the bottom of the bore hole as illustrated in FIG. 1. The teeth which are at the maximum position above the bottom of the bore hole are on the same side of the axis of the drill bit as is the nozzle 11. Drilling mud is injected into the hole through the opening 17 in the nozzle 11 such that it removes detritus from between the teeth 21 which are not in contact with the bottom of the bore hole.

The elongated shape of the opening 17 of the nozzle 11 optimizes the hydraulic diameter D of the nozzle. The hydraulic diameter of the nozzle opening is given by the following formula:

$$\text{Hydraulic diameter} = 4\ (\text{area/perimeter})$$

The elongated nozzle of the present invention provides a nozzle with the same hydraulic diameter as a circular nozzle but which is narrower thereby allowing it to be placed lower on the body. In other words, a large opening is provided which utilizes a relatively small annular space. This is extremely important in a device such as a rotary drill bit of the present invention because of the critical space limitations of the drill bit. The large hydraulic diameter using the small annular space permits a comparatively large volume of drilling fluid to be injected into the bore hole and thereby enhances the removal of detritus from between the cutting teeth and the bottom of the bore hole.

Figure 3:
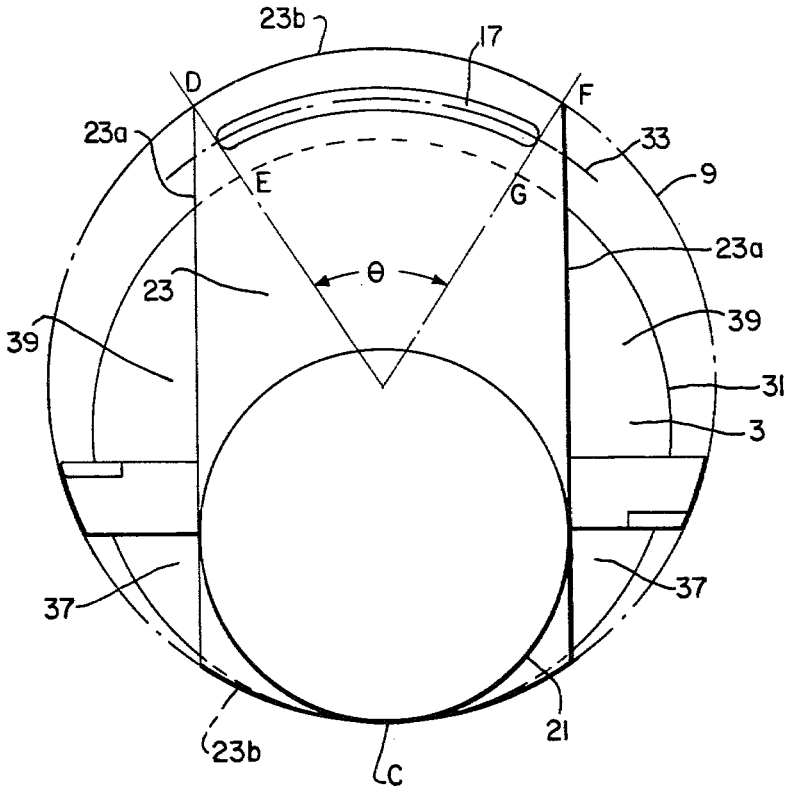
FIG. 3 is a plan view illustrating the relationship of various elements of the present invention.

FIG. 3 illustrates the relationship of the various elements of the drill bit of the present invention and is helpful in illustrating the operation of the drill bit. Referring to FIG. 3, the outer periphery 31 of the cutting head 3 is tangent to the bore hole 9 at point C. The conical surface of the first portion of the body 21 is also tangent to the side of the bore hole at point C. The second or upper portion of the body 23 has cylindrical portions 23*b* which contact the surface of the bore hole 9 and planar portions 23*a*. Nozzle opening 17 is positioned within the body so that its longitudinal center line 33 coincides with the locus of the mid-point between the side of the bore hole 9 and the outer periphery of the cutting head 31. The angular length of the nozzle $\theta$ is such that the area of the space between the side of the bore hole and the outer periphery of the cutting head DEFG is equal to the areas DEC and FGC. This provides equal area for the injection and removal of drilling fluid.

In operation, drilling fluid is injected into the bore hole through the nozzle opening 17. The nozzle is formed so that the sides of the jet which enters the bore hole are parallel to one another and to the sides of the nozzle. This results in the drilling fluid passing through the space 35 between the outermost circumference of the cutting head 31 and the side of the bore hole 9. This is shown in FIG. 1. Since the jet from the nozzle passes through the space 35, it does not create turbulence in flow in space 35 which could result in drilling fluid getting into the space between the cutting head and body and causing damage to the seal (not shown) between these two members.

The shape and position of conical portion 21 of the body permits the positioning of the portion 25 with the nozzle 11 therein to be such that the nozzle is at the lowest possible point on the body 1. It is, of course, necessary in the formation of portion 25 with the nozzle 11 therein that the amount of material surrounding the nozzle be sufficient to withstand the extreme conditions found in a downhole environment. The relationship of the portions 21 and 25 permits the formation of piece 25 to accomplish this.

Another very significant feature of the drill bit is the effect of the shape of portions 21 and 23 on the flow of drilling fluid and detritus upward from the bottom of the bore hole. The shape of conical portion 21 results in a substantial amount of space 37 between the side surface of the bore hole and the drill bit body at the lower portion of the drill bit body. Further, the planar portions 23*a* of the upper portion 23 also results in substantial space 39. Thus, passages are formed between the drill bit body portions 21 and 23 for the upward flow of drilling fluid and detritus from the bottom of the bore hole. Stabilizers 27 compensate for any instability caused by the shaping of the body 1 to form the passages.

Figure 4:
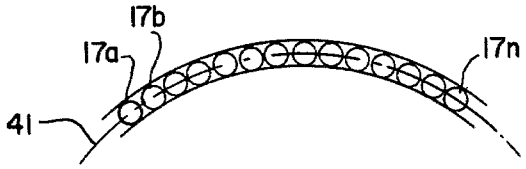
FIG. 4 illustrates an alternate embodiment of the elongated nozzle of the present invention.

In FIG. 3, the nozzle opening 17 is a single elongated opening. Alternative embodiments such as that shown in FIG. 4 can be used where the nozzle opening is formed from a plurality of smaller openings 17*a*–17*n* where the smaller openings are aligned along the locus or longitudinal center line 41.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A rotary drill bit for drilling a bore hole in the surface of the earth, said drill bit comprising:

(a) a body means having a duct means therethrough for carrying drilling fluid;

(b) a conical cutting head having an axis at an acute angle with respect to the axis of said drill bit, said cutting head having a conical head portion with a plurality of teeth thereon and a stem portion, said stem portion being positioned in said body means for mounting said cutting head on said body means; and (c) an elongated nozzle means positioned at the end of said duct means for injecting said drilling fluid in an arcuate jet into the bore hole, said nozzle means having an opening means opening into said bore hole, wherein the longitudinal center line of said opening means is arcuate and follows the locus of the midpoint between the side wall of the bore hole, adjacent said nozzle means, and the outermost circumference of the side of the cutting head means, on the same side of the axis thereof as said nozzle means, wherein the drilling fluid injected through said nozzle means removes detritus from between the teeth of said cutting head and from the bottom of the bore hole.

2. A rotary drill bit as set forth in claim 1, wherein said body means has a first portion having a truncated conical surface, the axis of said truncated cone coinciding with the axis of said cutting head means and wherein the surface of the truncated cone is tangent to the side surface of the bore hole at a line on the opposite side of the body means from said nozzle means and wherein a passage for the upward flow of drilling fluid and detritus is formed between the surface of said truncated cone and the side surface of the bore hole.

3. A rotary drill bit as set forth in claim 2, wherein said body means includes a second portion positioned above said first portion, said second portion having a cylindrical surface with a diameter corresponding to the diameter of said bore hole.

4. A rotary drill bit as set forth in claim 3, wherein planar surfaces are formed on opposite sides of said cylindrical surface passages thereby being formed between the planar surfaces and the sides of the bore hole for the upward flow of drilling fluid and detritus.

5. A rotary drill bit as set forth in claim 3, wherein said body means includes a third portion, said third portion being fixed to said first and second portions, wherein said nozzle means is positioned in said third portion.

6. A rotary drill bit as set forth in claim 2, including stabilizer means mounted on said first portion, said stabilizer means contacting the side surface of said bore hole to stabilize the rotation of said drill bit.

7. A rotary drill bit as set forth in claim 6, wherein said stabilizer means includes cutting portions for cutting the side surfaces of said bore hole.

8. A rotary drill bit as set forth in claims 1 or 2, wherein the outermost circumference of the cutting head is tangent to the side surface of the bore hole along a single line, and a space is formed between the remainder of the outermost circumference and the side surface of the bore hole.

9. A rotary drill bit as set forth in claim 8, wherein the area of said space defined by the angle subtended by the length of said opening means is equal to one half the total area of said space.

10. A rotary drill bit as set forth in claim 5, wherein said first and second portions of said body means are integral and said third portion is mounted on said first portion.

11. A rotary drill bit as set forth in claim 1, wherein said nozzle means includes a portion made of a material and which is harder than the material of said body means.

12. A rotary drill bit as set forth in any of claims 1–11, wherein said opening means comprises a single elongated opening.

13. A rotary drill bit as set forth in any of claims 1–11, wherein said opening means comprises a plurality of openings aligned on said locus of the longitudinal center line.

14. A rotary drill bit as set forth in any of claims 1–11, wherein said nozzle means injects a stream of said drilling fluid into the bore hole wherein said stream has parallel sides corresponding to the longitudinal sides of said opening means.

15. A rotary drill bit for drilling a hole in the surface of the earth said drill bit comprising:

(a) a body means having a passage means therethrough, said passage means adapted for carrying drilling fluid injected through a drill string, said body means including a first portion having a truncated conical surface;

(b) a conical cutting head mounted in said body means, the axis of said cutting head being at an acute angle with respect to the axis of said drill bit wherein the axis of said truncated conical surface coincides with the axis of said conical cutting head; and (c) elongated nozzle means mounted on said body means on a side thereof opposite to the side of said first portion for injecting an arcuate jet of drilling fluid into the bore hole wherein said body means includes a second portion having a cylindrical surface positioned above said first portion wherein the longitudinal center line of said elongated nozzle is arcuate and is located on the locus of the mid-point between the outermost circumference of the side of said cutting head means on the same side of the axis thereof as said nozzle means, and the downward projection of said cylindrical surface on the same side of the axis thereof as said nozzle means.

16. A rotary drill bit as set forth in claim 15, wherein said body means includes a third portion said third portion being fixed to said first and second portions, wherein said nozzle means is mounted in said third portion and a portion of said passage means is within said third position and wherein at least a portion of the outer surface of said third portion is cylindrical, said cylindrical portion being aligned with the cylindrical surface of said second portion.

17. A rotary drill bit as set forth in claim 16, including stabilizer means mounted on said first portion.

18. A rotary drill bit as set forth in claim 16, wherein said first and second portions of said body means are integral and said third portion is mounted on said first portion.

19. A rotary drill bit as set forth in claim 15, wherein said nozzle means includes a portion made of a metal and which is harder than the material of said body means.

20. A rotary drill bit as set forth in any of claims 15 and 16–19, wherein said nozzle means is adapted to form a stream of drilling fluid having parallel sides corresponding to the longitudinal sides of said opening means.

21. A rotary drill bit as set forth in any of claims 15 and 16–19, wherein said opening means comprises a single elongated opening.

22. A rotary drill bit as set forth in any of claims 15 and 17–20, wherein said opening means comprises a plurality of openings aligned on said locus of the longitudinal center line.

* * * * *

UNITED STATES PATENT AND TRADEMARK OFFICE

CERTIFICATE OF CORRECTION

PATENT NO. : 4,351,402

DATED : September 28, 1982

INVENTOR(S) : Eduardo Barnetche-Gonzalez

It is certified that error appears in the above-identified patent and that said Letters Patent is hereby corrected as shown below:

On the Title page, Item [76], Inventor's name "Eduardo B. Gonzalez" should read-- Eduardo Barnetche-Gonzalez--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*